US005394999A

United States Patent [19]

Krall

[11] Patent Number: 5,394,999

[45] Date of Patent: Mar. 7, 1995

[54] CHILD RESISTANT PACKAGE

[75] Inventor: Thomas J. Krall, Toledo, Ohio

[73] Assignee: Owens-Illinois Closure Inc., Toledo, Ohio

[21] Appl. No.: 57,077

[22] Filed: May 6, 1993

[51] Int. Cl.[6] ..... B65D 55/02

[52] U.S. Cl. ..... 215/209; 215/216; 215/221; 215/330

[58] Field of Search ..... 215/209, 216, 221, 330

[56] References Cited

U.S. PATENT DOCUMENTS

| | | | |
|---|---|---|---|
| 3,700,133 | 10/1972 | Bagguley | 215/221 |
| 3,805,987 | 4/1974 | Horvath . | |
| 3,877,597 | 4/1975 | Montgomery et al. . | |
| 3,881,625 | 5/1975 | Landen | 215/221 |
| 3,884,379 | 5/1975 | Landen | 215/221 |
| 3,891,110 | 6/1975 | Gach . | |
| 3,894,647 | 7/1975 | Montgomery . | |
| 3,902,620 | 9/1975 | McIntosh | 215/209 |
| 3,974,929 | 8/1976 | Montgomery . | |
| 4,002,259 | 1/1977 | Geiser . | |
| 4,036,385 | 7/1977 | Morris . | |
| 4,103,797 | 8/1978 | Morris . | |
| 4,427,124 | 1/1984 | Marhsall et al. | 215/216 |
| 4,464,316 | 8/1984 | Michaels | 215/216 X |
| 4,473,162 | 9/1984 | Donoghue | 215/209 |
| 4,511,049 | 4/1985 | Aboud | 215/216 |
| 5,230,433 | 7/1993 | Hamilton et al. | 215/221 |

*Primary Examiner*—Allan N. Shoap
*Assistant Examiner*—Vanessa Caretto

[57] ABSTRACT

A child resistant package including a plastic container having a finish with an external thread and a plastic closure having a base wall and an internal thread thereon for engaging the thread on the container. The container includes diametrically opposed integral tabs extending from the container. Each tab has substantially uniform thickness such that it is capable of flexing relative to said container. The skirt of the closure has a free edge with diametrically opposed projections thereon engagable by the radial tabs. The tabs are manually deflectable to disengage from said projections on the skirt to permit manual rotation of the closure to unthread said closure from the container. In one form the tabs comprise a first portion extending radially outwardly and a second portion extending axially downwardly and the projections comprise axially extending projections on the inner surface of the skirt of the closure with notches on the skirt through which a finger of a user can be provided to deflect the area of juncture of the radial and axial portions of each tab from its respective projection. In another form, the tabs extend radially from the finish of the container and engage projections defined by notches in the peripheral skirt of the closure.

2 Claims, 2 Drawing Sheets

CHILD RESISTANT PACKAGE

This invention relates to child resistant packages and particularly to plastic child resistant packages.

BACKGROUND AND SUMMARY OF THE INVENTION

Child resistant packages comprising a plastic closure and a plastic container are well known in the art as shown for example in the following U.S. Pat. Nos. 3,805,987; 3,877,595; 3,891,110; 3,894,647; 3,974,929; 4,002,259; 4,036,385 and 4,103,797.

Among the objectives of the present invention are to provide a child resistant package which utilizes a closure having deformable tabs and which are adapted to engage anti-rotation projection on the closure; which minimizes the number of parts used; wherein the closure and container can be made by well known processes; and wherein the package is relatively economical to make while maintaining the desired child resistant construction.

In accordance with the invention, a child resistant package including a plastic container having a finish with an external thread and a plastic closure having a base wall and an internal thread thereon for engaging the thread on the container. The container includes diametrically opposed integral tabs extending from the container. Each tab has substantially uniform thickness such that it is capable of flexing relative to said container. The skirt of the closure has a free edge with diametrically opposed projections thereon engageable by the radial tabs. The tabs are manually deflectable to disengage from said projections on the skirt to permit manual rotation of the closure to unthread said closure from the container. In one form, the tabs comprise a first portion extending radially outwardly and a second portion extending axially downwardly and the projections comprise axially extending projections on the inner surface of the skirt of the closure with notches on the skirt through which a finger of a user can be provided to deflect the area of juncture of the radial and axial portions of each tab from its respective projection. In another form, the tabs extend radially from the finish of the container and engage projections defined by notches in the peripheral skirt of the closure.

DESCRIPTION

Figure 1:
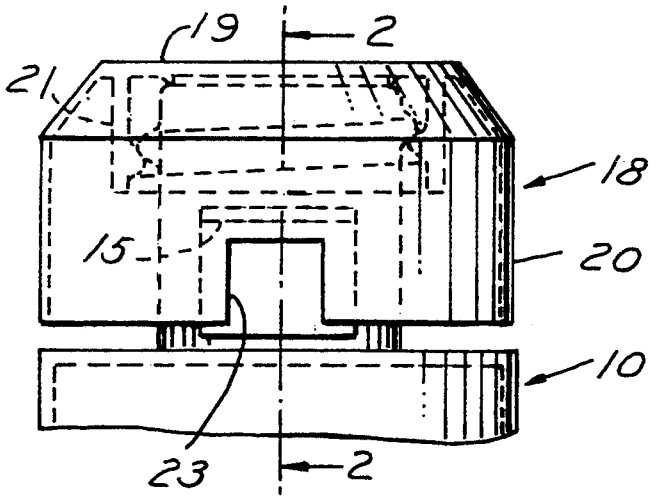
FIG. 1 is a fragmentary front elevational view of a child resistant package embodying the invention.
Figure 2:
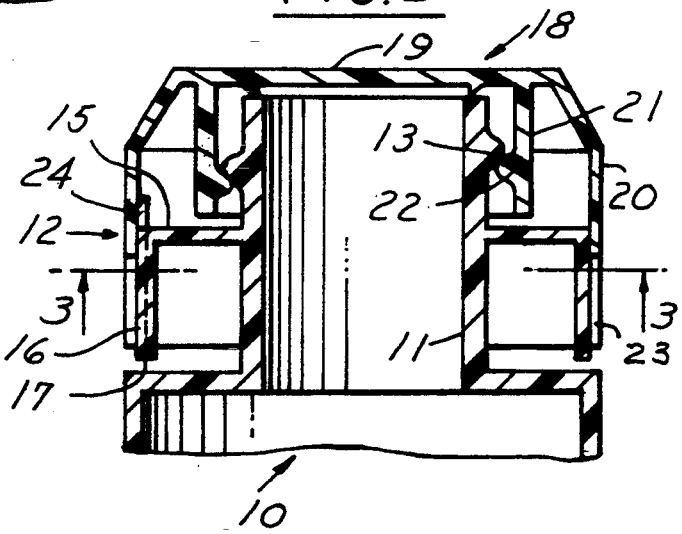
FIG. 2 is a fragmentary sectional view taken along the line 2—2 in FIG. 1.
Figure 3:
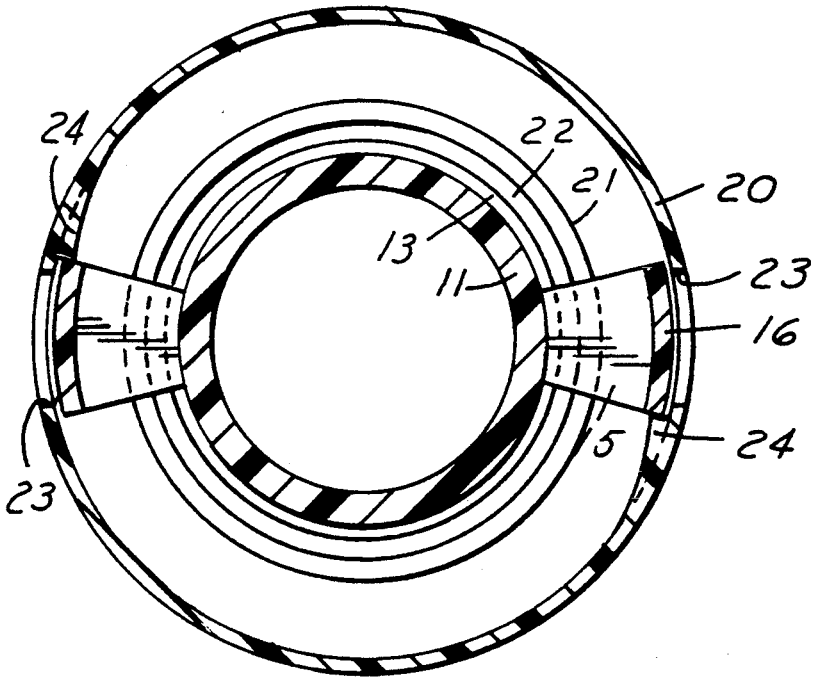
FIG. 3 is a sectional view taken along the line 3—3 in FIG. 2.
Figure 4:
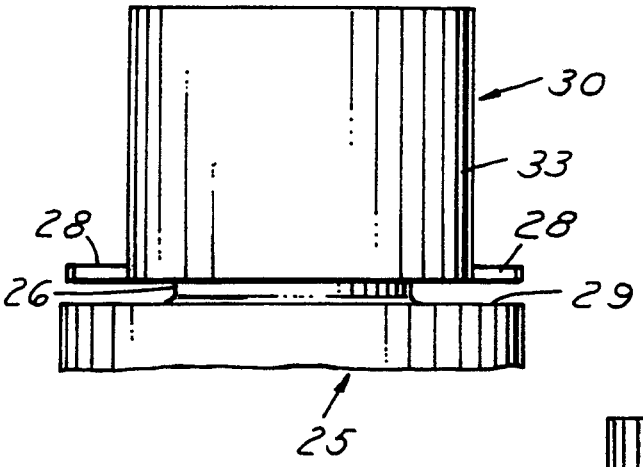
FIG. 4 is a fragmentary elevational view of a modified form of child resistant package.
Figure 5:
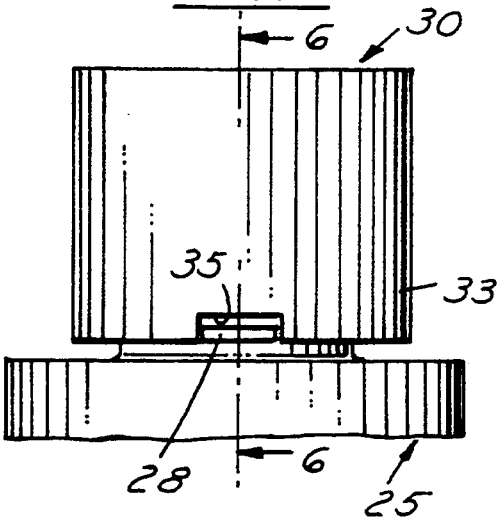
FIG. 5 is a side elevational view of the package shown in FIG. 4.
Figure 6:
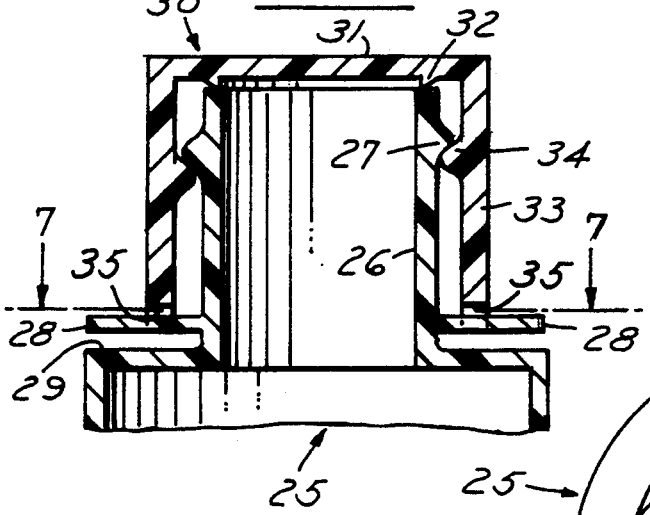
FIG. 6 is a fragmentary sectional view taken along the line 6—6 in FIG. 5.
Figure 7:
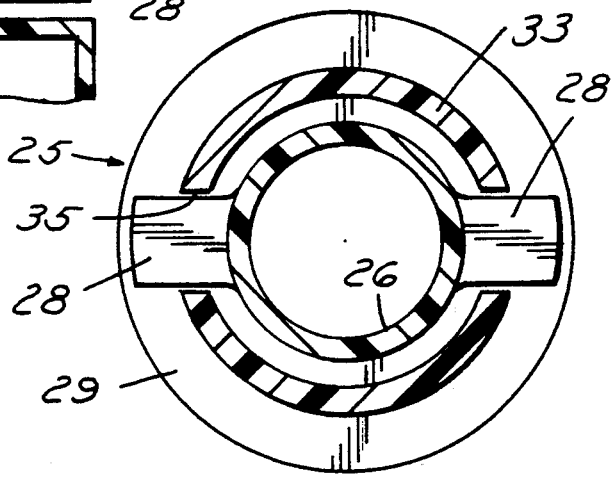
FIG. 7 is a sectional view taken along the line 7—7 in FIG. 6.

Referring to FIGS. 1–3, in one form of child resistant package made in accordance with the invention, the package comprises a plastic container 10 having an integral finish 11 with diametrically opposed integral tab 12 extending radially outwardly from the neck below integral external threads 13. Each tab 12 includes an integral radial portion 15 and an axial portion 16 terminating axially in a free edge 17.

The package further includes a plastic closure 18 having a base wall 19 and a peripheral skirt 20. The closure 18 further includes an intermediate or inner wall 21 formed with an integral thread 22 on its inner surface engaging the external thread 13 on the finish 11 of the container.

The peripheral skirt 20 is provided with diametrically opposed axially extending notches 23. The skirt 20 further includes axially extending diametrically opposed anti-rotation projections 24 on its inner surface that are normally engaged by the radially outermost portion of the radial portion 15 of each tab 12.

When the closure 12 is threaded in clockwise fashion looking down on the closure, the tabs 12 deflect past the lugs 24 until the closure 18 is fully threaded on the container and the portions 16 of tabs 12 are aligned with notches 23. The lugs 24 being tapered in an anti-clockwise rotation as viewed in FIG. 3 function to maintain the closure on the container 10. When it is desired to remove the closure, the user grasps the closure pressing inwardly through notches 23 on the opposed tabs 12 to deflect them sufficiently so that the closure can be rotated after being disengaged from the lugs 24.

In the form shown in FIGS. 4–7, the container 25 includes a finish 26 having an external thread 27 and radially extending thin flat tabs 28 that lie in a radial plane intersecting the axis of the finish 26 and projecting radially outwardly from the finish 26 adjacent the upper end 29 of the container 25.

The plastic closure 30 includes a base wall 31 with an integral sealing lip 32 on its inner surface and a peripheral skirt 33 with an internal thread 34 for engaging the external thread 27 on the container 25. Notches 35 are provided in diametrically opposed relationship on the lower edge of the skirt 33 which are flexed downwardly by the free edge of the skirt 33 as the closure is being applied. The tabs 28 flex upwardly and engage the notches 35 when the closure is fully threaded on the container. When it is desired to remove the closure, the tabs 28 are flexed downwardly by the user disengaging from the notches 35 permitting rotation of the closure 30.

The containers 10, 25 may be made of any suitable plastic such as polypropylene or polyethylene. The closures may also be made of polypropylene or polyethylene.

It can thus be seen that there has been provided a child resistant package which utilizes a closure having deformable tabs and which are adapted to engage anti-rotation projection on the closure; which minimizes the number of parts used; wherein the closure and container can be made by well known processes; and wherein the package is relatively economical to make while maintaining the desired child resistant construction.

I claim:

1. A child resistant package including:

a plastic container having a finish having an external thread, and a plastic closure having a base wall and a peripheral skirt having an inner surface, said closure having an internal thread thereon for engaging the external thread on the container, said container including diametrically opposed integral tabs extending from the container, each tab comprising a first portion extending radially outwardly from said container and a second portion extending axially downwardly from said first portion, each said first tab portion and said second tab portion having substantially uniform thickness such that it is capable of flexing relative to said container, said closure having a free edge with diametrically opposed projections thereon engageable by said tabs to prevent removal, said peripheral skirt having notches therethrough adjacent said second portion of each said tab through which fingers of a user can be positioned to deflect manually the radial and axial portions of each tab from its respective projections to disengage the second portions of said tabs from said projections on the skirt to permit manual rotation of the closure to unthread said closure from the container.

2. The child resistant package set forth in claim 1 wherein said closure has an intermediate wall having said internal thread thereon, and said projections on said closure comprising axially extending projections on the inner surface of said skirt of said closure.

* * * * *